US006722058B2

(12) United States Patent
Lucas et al.

(10) Patent No.: US 6,722,058 B2
(45) Date of Patent: Apr. 20, 2004

(54) SHOE CARTRIDGE CUSHIONING SYSTEM

(75) Inventors: Robert J. Lucas, Erlangen (DE); Allen W. Van Noy, Weisendorf (DE); Vincent Philippe Rouiller, Herzogenaurach (DE); Wolfgang Scholz, Lonnerstadt (DE)

(73) Assignee: adidas International B.V., Amsterdam (NL)

( * ) Notice: Subject to any disclaimer, the term of this patent is extended or adjusted under 35 U.S.C. 154(b) by 0 days.

(21) Appl. No.: 10/099,859

(22) Filed: Mar. 15, 2002

(65) Prior Publication Data

US 2002/0129516 A1 Sep. 19, 2002

(30) Foreign Application Priority Data

Mar. 16, 2001 (DE) ..... 101 12 821

(51) Int. Cl.[7] ..... A43B 13/18; A43B 5/00
(52) U.S. Cl. ..... 36/28; 36/35 R; 36/37
(58) Field of Search ..... 36/28, 35 R, 37, 36/142, 143, 144

(56) References Cited

U.S. PATENT DOCUMENTS

| | | | | |
|---|---|---|---|---|
| 4,314,413 A | | 2/1982 | Dassler | |
| 4,354,318 A | | 10/1982 | Frederick et al. | |
| 4,391,048 A | | 7/1983 | Lutz | |
| 4,592,153 A | | 6/1986 | Jacinto | |
| 4,616,431 A | * | 10/1986 | Dassler | 36/28 |
| 4,771,554 A | | 9/1988 | Hannemann | |
| 4,843,741 A | * | 7/1989 | Yung-Mao | 36/114 |
| 4,881,329 A | | 11/1989 | Crowley | |
| 5,052,130 A | | 10/1991 | Barry et al. | |
| 5,060,401 A | | 10/1991 | Whatley | |
| 5,191,727 A | | 3/1993 | Barry et al. | |
| 5,279,051 A | | 1/1994 | Whatley | |
| 5,343,639 A | * | 9/1994 | Kilgore et al. | 36/29 |
| 5,353,523 A | | 10/1994 | Kilgore et al. | |
| 5,381,608 A | | 1/1995 | Claveria | |
| D355,755 S | | 2/1995 | Kilgore | |
| 5,461,800 A | | 10/1995 | Luthi et al. | |
| 5,488,786 A | | 2/1996 | Ratay | |
| 5,544,431 A | * | 8/1996 | Dixon | 36/38 |
| 5,560,126 A | | 10/1996 | Meschan et al. | |
| 5,644,857 A | | 7/1997 | Ouellette et al. | |
| 5,678,327 A | | 10/1997 | Halberstadt | |
| 5,718,063 A | | 2/1998 | Yamashita et al. | |
| 5,743,028 A | | 4/1998 | Lombardino | |
| 5,782,014 A | | 7/1998 | Peterson | |
| 5,806,210 A | | 9/1998 | Meschan | |
| 5,826,352 A | | 10/1998 | Meschan et al. | |
| 5,918,384 A | | 7/1999 | Meschan | |
| 5,937,544 A | * | 8/1999 | Russell | 36/28 |
| 5,937,545 A | | 8/1999 | Dyer et al. | |
| 5,970,628 A | | 10/1999 | Meschan | |
| 5,983,529 A | * | 11/1999 | Serna | 36/28 |
| 5,996,253 A | | 12/1999 | Spector | |
| 6,023,859 A | | 2/2000 | Burke et al. | |
| 6,029,374 A | | 2/2000 | Herr et al. | |
| 6,115,944 A | | 9/2000 | Lain | |
| 6,487,796 B1 | * | 12/2002 | Avar et al. | 36/28 |
| 6,568,102 B1 | * | 5/2003 | Healy et al. | 36/28 |

FOREIGN PATENT DOCUMENTS

| | | |
|---|---|---|
| EP | 0 359 421 | 8/1994 |
| EP | 0 815 757 | 1/1998 |
| EP | 0 877 177 | 11/1998 |
| EP | 0 714 611 | 12/1998 |
| WO | WO 97/13422 | 4/1997 |

* cited by examiner

*Primary Examiner*—M. D. Patterson
(74) *Attorney, Agent, or Firm*—Testa, Hurwitz & Thibeault, LLP

(57) ABSTRACT

The present invention relates to a shoe sole, in particular for a sports shoe, where the sole includes a cartridge cushioning system that includes a load distribution plate arranged in a heel region of the shoe sole, at least one cushioning element for determining the cushioning properties of the shoe sole during the first ground contact with the heel, and at least one guidance element to guide the foot into a neutral position after the first ground contact.

18 Claims, 4 Drawing Sheets

SHOE CARTRIDGE CUSHIONING SYSTEM

CROSS-REFERENCE TO RELATED APPLICATION

This application incorporates by reference, and claims priority to and the benefit of, German patent application serial number 10112821.5, titled "Shoe Sole," which was filed on Mar. 16, 2001.

TECHNICAL FIELD

The present invention relates to a cushioning system for a shoe using foam components having different shapes and densities.

BACKGROUND

When shoes, in particular sports shoes, are manufactured, one objective is to restrict the movements of a wearer of the shoe as little as possible. On the other hand, the different loads that arise on the skeleton and the muscles during running should be moderated to reduce fatigue or the risk of injuries under long lasting loads. One cause of premature fatigue of the joints or the muscles is the misorientation of the foot during a step cycle. Typically, professional athletes run exclusively on their forefoot, in particular during track and field events; however, the average amateur athlete first contacts the ground with the heel and subsequently rolls-off using the ball of the foot.

Under a correct course of motion, most athletes perform a slight turning movement of the foot from the outside to the inside between the first ground contact with the heel and the pushing-off with the ball. Specifically, at ground contact, the athlete's center of mass is more on a lateral side of the foot, but shifts to a medial side during the course of the step cycle. This natural turning of the foot to the medial side is called pronation. Supination, i.e., the turning of the foot in the opposite direction, as well as excessive pronation, can lead to increased strain on the joints and premature fatigue or even injury. Therefore, when designing shoes, in particular sports shoes, it is desirable to precisely control the degree of turning of the foot during a step cycle in order to avoid the above-mentioned misorientations.

There are a number of known devices that influence pronation. For example, supporting elements may be placed in the midfoot and the forefoot areas of a sole to avoid excessive turning of the foot to the medial and/or to the lateral side during push-off. Typically, the heel portion of these soles is a simple cushioning element serving only to absorb the arising ground reaction forces. This approach, however, fails to recognize that the first phase of a step cycle influences the later course of motion of the foot. When the foot terminates the ground-contacting phase in the correct orientation prior to transitioning to the pushing-off phase, an essential requirement for an overall correct course of motion is obtained.

It is, therefore, an object of the present invention to provide a shoe sole that leads to a correct orientation of the foot starting from the first ground contact, thereby reducing or eliminating premature fatigue or wear of the joints and the muscles.

SUMMARY OF THE INVENTION

The invention generally relates to a cartridge cushioning system that incorporates a cushioning element to protect the joints and muscles of an athlete against the ground reaction forces arising during a first ground contact and at least one guidance element having a material property that assures that immediately after ground contact (and not only in the later phase of the step cycle) pronation control takes place, thereby bringing the foot into an intermediate position, which is correct for this stage of the step cycle. In a shoe sole having two guidance elements, for example a lateral and a medial guidance element, the combined effect of these two elements during ground contact is to control the transition of the center of mass of the load from the lateral rear side to the center of the heel.

The system further includes a load distribution plate in the heel region that facilitates uniform force distribution on the athlete's heel and evenly transmits the cushioning and guiding effects of the above-mentioned elements to the complete heel region and not just to single parts of the heel. Further, the load distribution plate may supply stability and support to the heel region of the shoe. An optional stability element can be included in the cartridge cushioning system. The stability element can have a material property that helps prevent excessive pronation during transition into the rolling-off phase of the step cycle.

Generally, the functional elements of a cartridge cushioning system in accordance with the invention provide for the complete pronation control of the athlete's foot, starting from the first ground contact until the transition to the rolling-off phase. Specifically, after compression of the cushioning element during the first ground contact, diagonally arranged guidance elements guide the center of mass of the load to the center of the heel. An optional stability element arranged in the medial front area of the heel assures that the center of mass does not excessively shift to the medial side in the course of a further turning of the foot.

In one aspect, the invention relates to a sole for an article of footwear. The sole includes a load distribution plate disposed in a heel region of the sole, a cushioning element disposed proximate the load distribution plate, and a guidance element disposed proximate the load distribution plate. The cushioning element is configured and located to determine a cushioning property of the sole during a first ground contact with the heel region. The guidance element is configured and located to bring a wearer's foot into a neutral position after the first ground contact.

In another aspect, the invention relates to an article of footwear having an upper and a sole attached thereto. The sole includes a load distribution plate disposed in a heel region of the sole, a cushioning element disposed proximate the load distribution plate, and a guidance element disposed proximate the load distribution plate. The cushioning element is configured and located to determine a cushioning property of the sole during a first ground contact with the heel region. The guidance element is configured and located to bring a wearer's foot into a neutral position after the first ground contact.

In various embodiments of the foregoing aspects, the sole includes a second guidance element disposed proximate the load distribution plate. The second guidance element is also configured and located to bring the wearer's foot into the neutral position after the first ground contact. The sole can also include a stability element disposed proximate the load distribution plate. The stability element is configured and located to avoid excessive pronation during transition to a rolling-off phase of a step cycle.

In various embodiments, the cushioning element is generally located in a lateral rear quadrant of the heel region, the guidance element is generally located in a lateral forward quadrant of the heel region, the second guidance element is generally located in a medial rear quadrant of the heel region, and the stability element is generally located in a medial forward quadrant of the heel region. Further, the cushioning element, the guidance element, the second guidance element, and the stability element are spaced apart. In one embodiment, the elements can be spaced equidistantly apart. The sole may include at least one reinforcing element disposed between at least one of the cushioning element and the guidance element, the guidance element and the second guidance element, the second guidance element and the stability element, the stability element and the cushioning element, the cushioning element and the second guidance element, and the guidance element and the stability element.

In additional embodiments, at least one of the guidance element, the second guidance element, and the stability element has a greater hardness than the cushioning element. In addition, the hardness of at least one of the guidance element, the second guidance element, and the stability element may vary, for example, by increasing from a rear portion to a front portion thereof. In one embodiment, the stability element may extend beyond an edge of the load distribution plate. In another embodiment, the load distribution plate may have a generally recumbent U-shaped cross-sectional profile and can at least partially circumscribe at least a portion of one of the cushioning element, the guidance element, the second guidance element, and the stability element. The closed end of the load distribution plate may be oriented towards a forefoot portion of the sole. The sole may also include an outsole at least partially disposed below the cushioning element, the guidance element, the second guidance element, and the stability element.

In yet another aspect, the invention relates to an article of footwear including an upper and a sole attached thereto. The sole includes a load distribution plate disposed in a heel region of the sole, a cushioning element disposed proximate the load distribution plate, a first guidance element disposed proximate the load distribution plate, a second guidance element disposed proximate the load distribution plate, and a stability element disposed proximate the load distribution plate. The cushioning element is generally located in a lateral rear quadrant of the heel region and is configured to determine a cushioning property of the sole during a first ground contact with the heel region. The first guidance element is generally located in a lateral forward quadrant of the heel region and is configured to bring a wearer's foot into a neutral position after the first ground contact. The second guidance element is generally located in a medial rear quadrant of the heel region and is configured to bring the wearer's foot into the neutral position after the first ground contact. The stability element is generally located in a medial forward quadrant of the heel region and is configured to avoid excessive pronation during transition to a rolling-off phase of a step cycle.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION OF THE INVENTION

Embodiments of the present invention are described below. It is, however, expressly noted that the present invention is not limited to these embodiments, but rather the intention is that variations, modifications, and equivalents that are apparent to the person skilled in the art are also included. In particular, the present invention is not intended to be limited to soles for sports shoes, but rather it is to be understood that the present invention can also be used to produce soles for any article of footwear. Further, only a left or right sole and/or shoe is depicted in any given figure; however, it is to be understood that the left and right soles/shoes are typically mirror images of each other and the description applies to both left and right soles/shoes.

Figure 1:
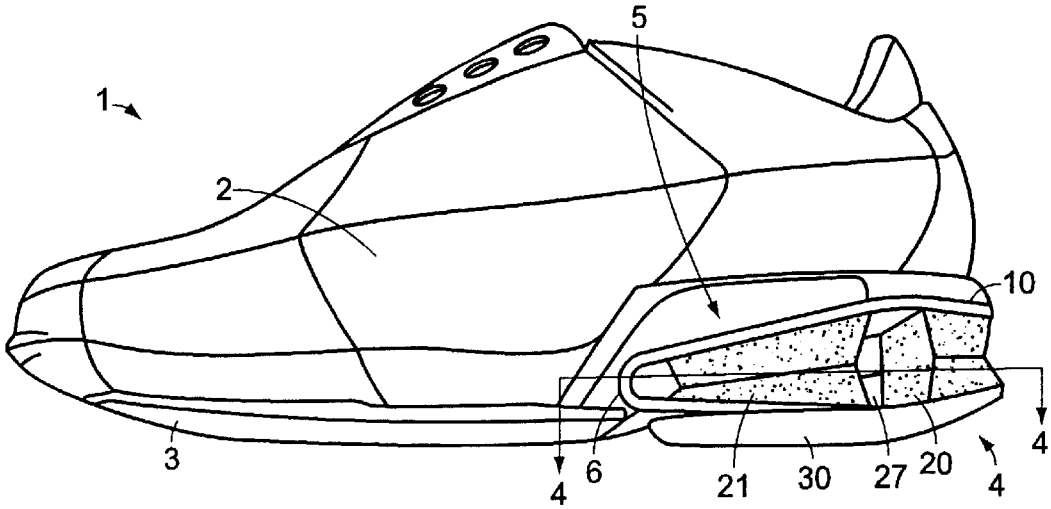
FIG. 1 is a schematic lateral view of a left shoe including a sole in accordance with the invention.
Figure 2:
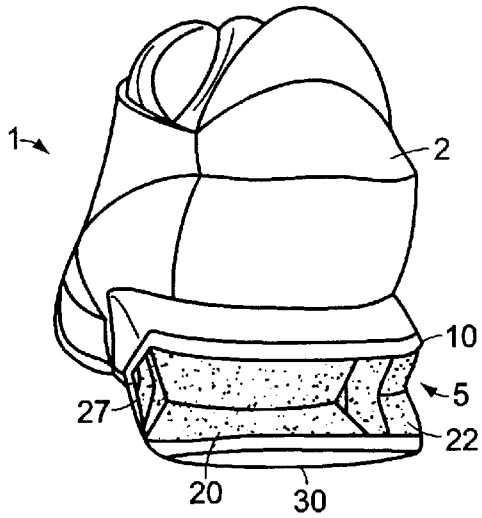
FIG. 2 is a schematic rear view of the shoe of FIG. 1.
Figure 3:
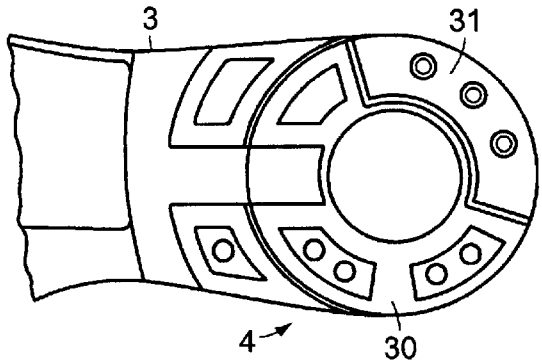
FIG. 3 is a partial schematic bottom view of the shoe of FIG. 1.

FIGS. 1–3 are various views of a shoe 1 including a sole 3 in accordance with the invention. FIG. 1 depicts a lateral side view of the shoe 1 including an upper 2 manufactured according to known methods and the sole 3. The sole 3 includes a cartridge cushioning system 5 that includes a load distribution plate 10 that extends in the heel region 4 of the sole 3. The load distribution plate 10 is shown having a generally recumbent U-shaped cross-sectional profile having a closed end 6; however, the load distribution plate 10 can be a single substantially planar piece. Several functional elements 20, 21, 22 are arranged proximate the load distribution plate 10. FIGS. 1 and 2 show a cushioning element 20 disposed in a rear portion of the heel region 4, a first guidance element 21 disposed in a front portion of the heel region 4, and a second guidance element 22 disposed on a medial side of the heel region 4. The load distribution plate 10 generally circumscribes and receives therein the various functional elements 20, 21, 22; however, in the embodiment where the load distribution plate 10 is a single piece, the functional elements 20, 21, 22 are typically disposed below the load distribution plate 10.

In the embodiment shown in FIGS. 1–3, the sole 3 includes an optional outsole 30 disposed at least partially below the heel region 4. In the embodiment shown in FIG. 3, the outsole 30 includes a separate section 31 that corresponds generally to the location of the cushioning element 20 and is able to deform at least somewhat independently from the outsole 30.

Figure 4:
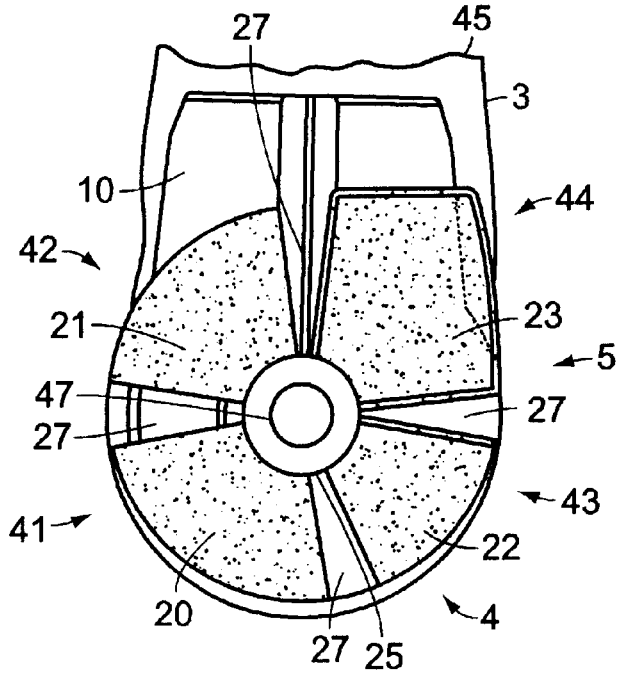
FIG. 4 is partial schematic cross-sectional view of the heel region of the sole of FIG. 1 taken at line 4—4.

FIG. 4 depicts a cross-sectional view of the heel region 4 of one embodiment of a cartridge cushioning system 5 in accordance with the invention. The heel region 4 is generally divided into four quadrants that correspond to specific regions of the heel. The four quadrants are the lateral rear portion 41, the lateral forward portion 42, the medial rear portion 43, and the medial forward portion 44. In this embodiment, four functional elements are generally disposed in the four quadrants of a generally circular area of the heel region 4. The cushioning element 20 is disposed substantially within the lateral rear quadrant 41. The first guidance element 21 is disposed substantially within the lateral forward quadrant 42, and the second guidance element 22 is disposed substantially within the medial rear quadrant 43. An optional stability element 23 is disposed substantially within the medial forward quadrant 44 and, in the embodiment shown, extends furthest into a midfoot portion 45 of the sole 3. In one embodiment, the stability element 23 can laterally extend beyond an edge of the load distribution plate 10 to better avoid excessive pronation.

Figure 5:
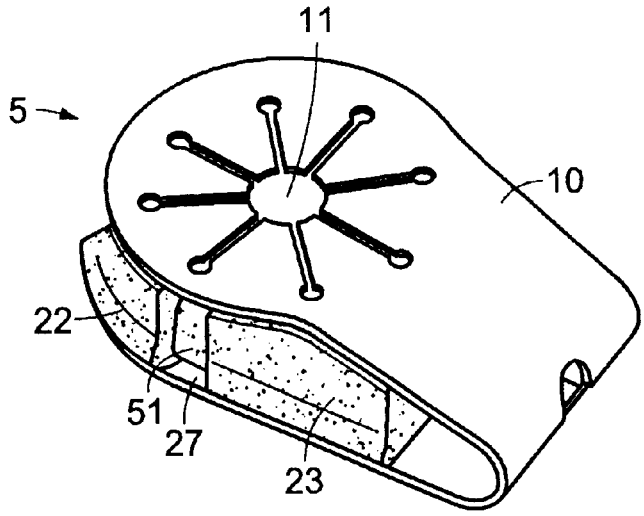
FIG. 5 is a schematic perspective view of one embodiment of a cartridge cushioning system in accordance with the invention.

In one embodiment, as shown in FIG. 5, the load distribution plate 10 has a U-shaped bend in the front area and receives in an interior region thereof the functional elements, for example, the stability element 23 and the second guidance element 22. The load distribution plate 10 can function as a structural element, with the functional elements 20, 21, 22, 23 inserted into its interior. The cartridge cushioning system 5 can supply the structure and stability necessary for a long lifetime of use.

As can be seen in FIGS. 1, 4, and 5, the functional elements 20, 21, 22, 23 are spaced apart, thereby forming gaps 27 between the cushioning element 20, the guidance elements 21, 22, and the stability element 23. In one embodiment and as shown in FIG. 5, additional reinforcing elements 51 can be inserted into these gaps 27. The additional reinforcing elements can be used, for example, if the shoe 1 will be subjected to particularly high loads. A further, highly viscous cushioning element 47 can, if necessary, be inserted into a generally circular recess 25 in the center of the load distribution plate 10 to provide additional cushioning directly below the calcaneus bone of the foot. As shown in FIG. 5, the load distribution plate 10 may include a star-like opening 11 disposed through the top of the plate 10. The opening 11 helps to assure uniform pressure distribution to the heel of the athlete. In addition to the star-like shape, the opening 11 may be other shapes that facilitate breathability and the anchoring of the functional elements 20, 21, 22, 23 within or below the load distribution plate 10.

Figure 6A:
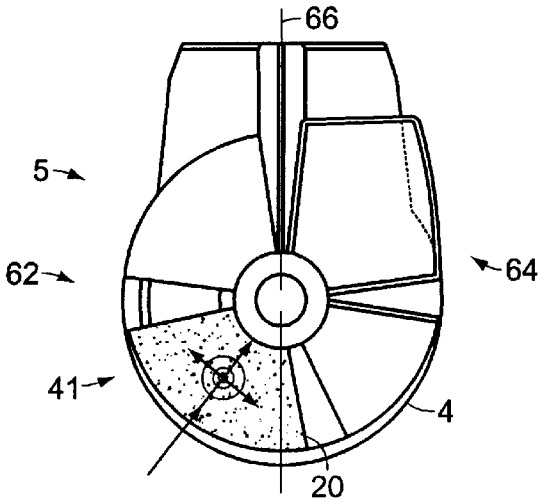
FIGS. 6A–6C are schematic representations of the cartridge cushioning system of FIG. 4 depicting the lines of forces arising during a step cycle starting from the first ground contact and transitioning into the rolling-off phase.
Figure 6B:
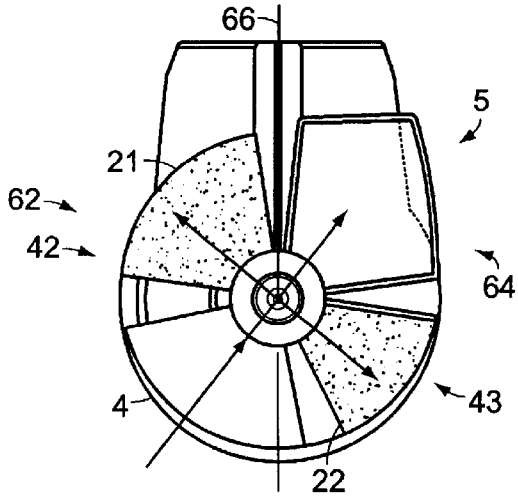
Figure 6C:
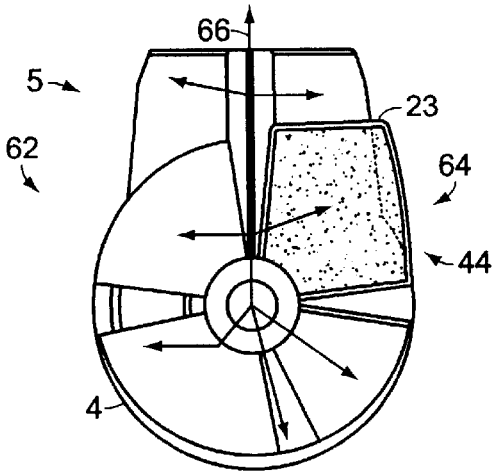

FIGS. 6A–6C depict the lines of forces arising during a step cycle starting from the first ground contact and transitioning into the rolling-off phase. The arrows reflect the force lines during the different stages of the ground contact phase. FIG. 6A depicts the first ground contact, which occurs with the major part of the athlete's weight on the lateral rear quadrant 41 of the heel region 4. The cushioning element 20 dissipates the energy transmitted during ground contact to the foot and, thus, protects the joints of the foot and the knee against excessive strains.

FIG. 6B shows the next step, when the athlete's weight transitions to the lateral front quadrant 42 and the medial rear quadrant 43. The guidance elements 21, 22 are now under load, as shown by the corresponding arrows, and by virtue of the matching material properties of the guidance elements 21, 22 orient the foot. In other words, the guidance elements 21, 22 bring the foot into a substantially parallel orientation with respect to the ground, i.e., a neutral position between supination and pronation. The center of mass of the load is shifted from its original position at the lateral rear quadrant 41 to the center of the heel region 4. This function of the guidance elements 21, 22 can be achieved by suitable material properties, in particular the compressibility of the elements 21, 22.

FIG. 6C shows the last stage of the ground-contacting phase just prior to the transition to the rolling-off with the midfoot portion and the forefoot portion of the sole 3. The optional stability element 23 stops the shift of the position of the center of mass from the lateral side 62 to the medial side 64 and helps to prevent excessive pronation. This is depicted in FIG. 6C by the arrows, which represent the redirecting of the force line along a longitudinal axis 66 of the shoe 1 so that the overall load is substantially evenly distributed between the medial side 64 and the lateral side 62 of the sole 3. Thus, the ground-contacting sequence schematically illustrated in FIGS. 6A–6C assures that the wearer's foot is oriented for a correct course of motion by the time the ground-contacting phase with the heel is terminated.

The functional elements 20, 21, 22, 23 can be manufactured from foamed elements, for example, a polyurethane (PU) foam based on a polyether. Alternatively, foamed ethylene vinyl acetate (EVA) can be used. Other suitable materials will be apparent to those of skill in the art. The desired element function, for example cushioning, guiding, or stability, can be obtained by varying the compressibility of the functional elements 20, 21, 22, 23. In one embodiment, the hardness values of the functional elements 20, 21, 22, 23 is in the range of about 55–70 Shore Asker C (ASTM 790), wherein the relative differences between cushioning, guidance, and stability depends on the field of use of the shoe and the size and the weight of the athlete. In one embodiment, the hardness of the cushioning element 20 is about Shore 60 C and the hardness of the guidance elements 21, 22 and the stability element 23 is about Shore 65 C. Different hardnesses or compressibilities can be obtained by, for example, different densities of the aforementioned foams. In one embodiment, the density of the first guidance element 21 and/or the second 22 guidance element, and/or the stability element 23 is not uniform, but varies such as by increasing from a rear portion of the element to a front portion of the element. In this embodiment, the compressibility decreases in this direction.

The size and shape of the functional elements 20, 21, 22, 23 may vary to suit a particular application. The elements 20, 21, 22, 23 can have essentially any shape, such as polygonal, arcuate, or combinations thereof. In the present application, the term polygonal is used to denote any shape including at least two line segments, such as rectangles, trapezoids, and triangles. Examples of arcuate shapes include circular and elliptical.

The load distribution plate 10 can be manufactured from lightweight stable plastic materials, for example, thermoplastic polyester elastomers, such as the Hytrel® brand sold by Dupont. Alternatively, a composite material of carbon fibers embedded into a matrix of resin can be used. Other suitable materials include glass fibers or para-aramid fibers, such as the Kevlar® brand sold by Dupont and thermoplastic polyether block amides, such as the Pebax® brand sold by Elf Atochem. Other suitable materials will be apparent to those of skill in the art. In one embodiment, the load distribution plate 10 has a hardness of about Shore 72 D. The size, shape, and composition of the load distribution plate 10 may vary to suit a particular application.

The load distribution plate 10 and functional elements 20, 21, 22, 23 can be manufactured, for example, by molding or extrusion. Extrusion processes may be used to provide a uniform shape. Insert molding can then be used to provide the desired geometry of open spaces, or the open spaces could be created in the desired locations by a subsequent machining operation. Other manufacturing techniques include melting or bonding. For example, the functional elements 20, 21, 22, 23 may be bonded to the load distribution plate 10 with a liquid epoxy or a hot melt adhesive, such as ethylene vinyl acetate (EVA). In addition to adhesive bonding, portions can be solvent bonded, which entails using a solvent to facilitate fusing of the portions to be added.

Figure 7:
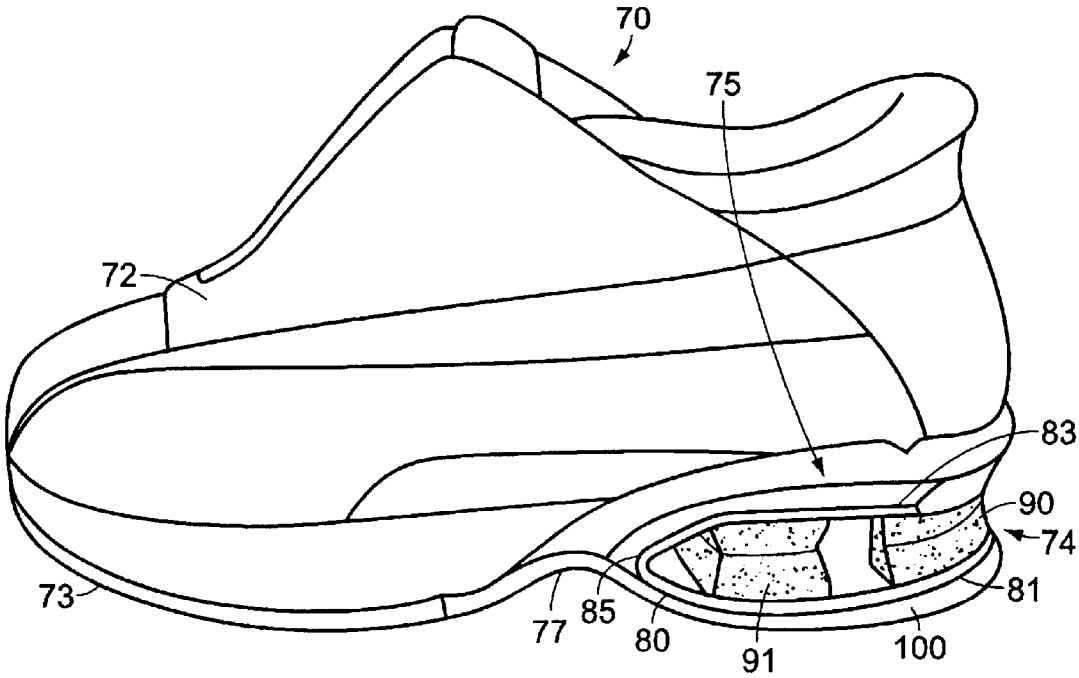
FIG. 7 is a schematic lateral view of a left shoe including an alternative embodiment of a sole in accordance with the invention.

FIG. 7 shows an alternative embodiment of the cartridge cushioning system 75 for use in a basketball shoe 70. As shown in FIG. 7, a lower part 81 of the U-shaped load distribution plate 80 extends beyond an upper part 83 of the plate 80 in the rear of the shoe 70 to increase the stability of the heel region 74. In addition, the load distribution plate 80 shown in FIG. 7 has a smaller radius of curvature in its closed end 85 to allow a more distinct support of an arch of the foot in the adjacent midfoot portion 77 of the shoe 70.

Figure 8:
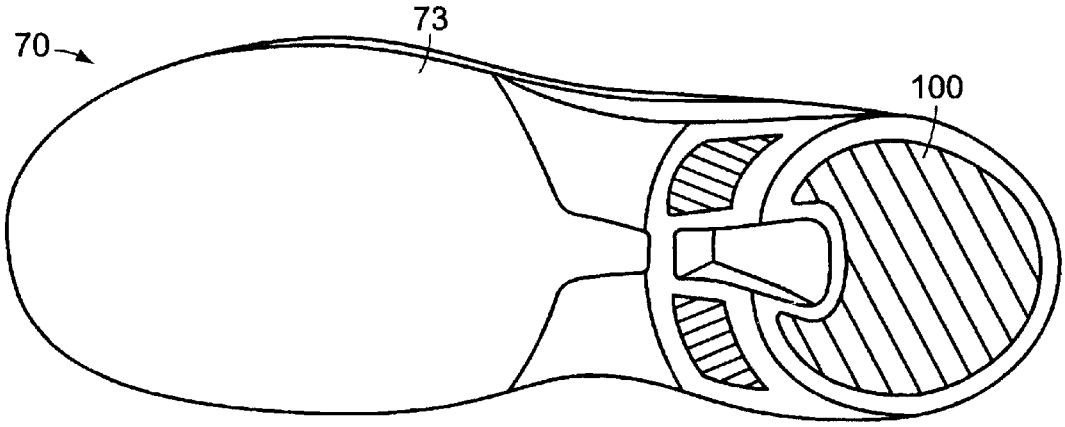
FIG. 8 is a schematic bottom view of the shoe of FIG. 7.

As shown in FIG. 8, the shoe 70 includes a continuous outsole 100, which is used advantageously in a shoe subjected to particularly high peak loads, for example, the basketball shoe of FIG. 7.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A sole for an article of footwear, the sole comprising:

a load distribution plate disposed in a heel region of the sole;

a cushioning element for determining a cushioning property of the sole during a first ground contact with the heel region, the cushioning element disposed proximate the load distribution plate and generally located in a lateral rear quadrant of the heel region; and a guidance element for bringing a wearer's foot into a neutral position after the first ground contact, the guidance element disposed proximate the load distribution plate and generally located in a lateral forward quadrant of the heel region, wherein the guidance element has a greater hardness than the cushioning element.

2. The sole of claim 1 further comprising a second guidance element for bringing the wearer's foot into the neutral position after the first ground contact, the second guidance element disposed proximate the load distribution plate.

3. The sole of claim 2 further comprising a stability element for avoiding excessive pronation of the wearer's foot during transition to a rolling-off phase of a step cycle, the stability element disposed proximate the load distribution plate.

4. The sole of claim 2, wherein the second guidance element is generally located in a medial rear quadrant of the heel region.

5. The sole of claim 3, wherein the stability element is generally located in a medial forward quadrant of the heel region.

6. The sole of claim 3, wherein the cushioning element, the guidance element, the second guidance element, and the stability element are spaced apart.

7. The sole of claim 6 further comprising at least one reinforcing element disposed between at least one of the cushioning element and the guidance element, the guidance element and the second guidance element, the second guidance element and the stability element, the stability element and the cushioning element, the cushioning element and the second guidance element, and the guidance element and the stability element.

8. The sole of claim 3, wherein at least one of the second guidance element and the stability element has a greater hardness than the cushioning element.

9. The sole of claim 3, wherein hardness of at least one of the guidance element, the second guidance element, and the stability element varies within the at least one of the guidance element, the second guidance element, and the stability element.

10. The sole of claim 3, wherein the stability element extends beyond an edge of the load distribution plate.

11. The sole of claim 3, wherein the load distribution plate has a generally recumbent U-shaped cross-sectional profile and receives in an interior region thereof at least a portion of one of the cushioning element, the guidance element, the second guidance element, and the stability element.

12. The sole of claim 11, wherein the closed end of the load distribution plate is oriented towards a forefoot portion of the sole.

13. The sole of claim 3 further comprising an outsole at least partially disposed below the cushioning element, the guidance element, the second guidance element, and the stability element.

14. An article of footwear comprising an upper and a sole, the sole comprising:

a load distribution plate disposed in a heel region of the sole;

a cushioning element for determining a cushion property of the sole during a first ground contact with the heel region, the cushioning element disposed proximate the load distribution plate and generally located in a lateral rear quadrant of the heel region; and a guidance element for bringing a wearer's foot into a neutral position after the first ground contact, the guidance element disposed proximate the load distribution plate and generally located in a lateral forward quadrant of the heel region, wherein the guidance element has a greater hardness than the cushioning element.

15. The article of footwear of claim 14 further comprising a second guidance element for bringing the wearer's foot into the neutral position after the first ground contact, the second guidance element disposed proximate the load distribution plate.

16. The article of footwear of claim 15, further comprising a stability element for avoiding excessive pronation of the wearer's foot during transition to a rolling-off phase of a step cycle, the stability element disposed proximate the load distribution plate.

17. The article of footwear of claim 16, wherein the second guidance element is generally located in a medial rear quadrant of the heel region and the stability element is generally located in a medial forward quadrant of the heel region.

18. An article of footwear comprising an upper and a sole, the sole comprising:

a load distribution plate disposed in a heel region of the sole;

a cushioning element for determining a cushioning property of the sole during a first ground contact with the heel region, the cushioning element disposed proximate the load distribution plate, and generally located in a lateral rear quadrant of the heel region;

a first guidance element for bringing a wearer's foot into a neutral position after the first ground contact, the first guidance element disposed proximate the load distribution plate and generally located in a lateral forward quadrant of the heel region;

a second guidance element for bringing the wearer's foot into the neutral position after the first ground contact, the second guidance element disposed proximate the load distribution plate and generally located in a medial rear quadrant of the heel region; and a stability element for avoiding excessive pronation of the wearer's foot during transition to a rolling-off phase of a step cycle, the stability element disposed proximate the load distribution plate and generally located in a medial forward quadrant of the heel region, wherein the guidance element has a greater hardness than the cushioning element.

* * * * *